US005890536A

United States Patent [19]

Nierode et al.

[11] Patent Number: 5,890,536

[45] Date of Patent: Apr. 6, 1999

[54] METHOD FOR STIMULATION OF LENTICULAR NATURAL GAS FORMATIONS

[75] Inventors: Dale E. Nierode, Kingwood; Walter J. Lamb, Houston, both of Tex.

[73] Assignee: Exxon Production Research Company, Houston, Tex.

[21] Appl. No.: 134,659

[22] Filed: Aug. 14, 1998

Related U.S. Application Data

[60] Provisional application No. 60/057,202, Aug. 26, 1997.

[51] Int. Cl. [6] ..... E21B 43/26; E21B 43/14

[52] U.S. Cl. ..... 166/284; 166/308; 166/297

[58] Field of Search ..... 166/308, 284, 166/297

[56] References Cited

U.S. PATENT DOCUMENTS

| | | | |
|---|---|---|---|
| 3,028,914 | 4/1962 | Flickinger | 166/284 |
| 3,427,652 | 2/1969 | Seay | 166/250.1 |
| 3,547,198 | 12/1970 | Slusser | 166/284 |
| 3,712,379 | 1/1973 | Hill | 166/297 |
| 4,139,060 | 2/1979 | Muecke et al. | 166/281 |
| 4,415,035 | 11/1983 | Medlin et al. | 166/308 |
| 4,867,241 | 9/1989 | Strubhar | 166/308 |
| 5,161,618 | 11/1992 | Jones et al. | 166/308 |
| 5,390,741 | 2/1995 | Payton et al. | 166/284 |

OTHER PUBLICATIONS

Kuuskraa and Prestridge: "Advanced Technologies for Producing Massively Stacked Lenticular Sands" *Society of Petroleum Engineers 35630*, pp. 505–514 1996.

Cipolla: "Hydraulic Fracture Technology in the Ozona Canyon and Penn Sands", *Society of Petroleum Engineers 35196*, pp. 455–466, 1996.

Cipolla and Wood: "A Statistical Approach to Infill Drilling Studies: Case History of the Ozona Canyon Sands", *Society of Petroleum Engineers 35628*, pp. 493–497, 1996.

Webster, Goins, Jr. and Berry: "A Continous Multistage Fracturing Technique", *Journal of Petroleum Technology,* pp. 619–625 (1965). Jun. 1965.

Von Albrecht, Diaz, Salathiel, and Nierode: "Stimulation of Asphaltic Deep Wells and Shallow Wells in Lake Maracaibo, Venezuela", *10 th World Petroleum Congress,* PD 7, pp. 55–62 (1979).

Stipp and Williford: "Pseudolimited Entry: A Sand Fracturing Technique for Simultaneous Treatment of Multiple Pays", *Journal of Petroleum Technology,* pp. 457–462 (1968).

Warpinski, Branagan, Sattler, Lorenz, Northrop, Mann, and Frohne: "Fracturing and Testing Case Study of Paludal, Tight, Lenticular Gas Sands", *Society of Petroleum Engineers/U.S. Department of Energy* 13876, pp. 267–275 (1985).

Williams, Nieto, Graham, and Leibach: "A Staged Fracturing Treatment for Multisand Intervals", *Journal of Petroleum Technology,* pp. 897–904 (1973).

(List continued on next page.)

*Primary Examiner*—David J. Bagnell
*Assistant Examiner*—Zakiya Walker
*Attorney, Agent, or Firm*—S. J. Casamassima

[57] ABSTRACT

A method for stimulating production from wells drilled into natural gas reservoirs characterized by lenticular deposits. The reservoir thickness through which the wells are drilled is divided into multi-stage zones that are further divided into single-stage zones. Each single-stage zone is perforated and then fractured. The fracturing is conducted in multiple stages to sequentially fracture each of the single-stage zones within a multi-stage zone; the fracturing stages being separated by ball sealers. Well spacing may also be controlled to match fracture drainage and size of the lenticular deposits.

25 Claims, 9 Drawing Sheets

OTHER PUBLICATIONS

Kordziel, Rowe, Dolan, Ritger: "A Case Study of Integrating Well–Logs and a Psuedo 3D Multi–Layer Frac Model to Optimize Exploitation of Tight Lenticular Gas Sands", *Society of Petroleum Engineers* 36886, pp. 129–141 (1996).

Sattler, Hudson, Raible, Gall, and Maloney: "Laboratory Studies for the Design and Analysis of Hydraulic Fractured Stimulations in Lenticular, Tight Gas Reservoirs", *Society of Petroleum Engineers 15245*, pp. 437–443 (1986).

Peterson and Kohout: "An Approximation of Continuity of Lenticular Mesaverde Sandstone Lenses Utilizing Close–Well Correlations, Piceance Basin, Northwestern Colorado", *Society of Petroleum Engineers/U.S. Department of Energy 11610*, (1983).

Bennion, Thomas, and Bietz, "Low Permeability Gas Reservoirs: Problems, Opportunities and Solutions for Drilling, Completion, Stimulation and Production", *Society of Petroleum Engineers 35577*, pp. 117–131 (1996).

METHOD FOR STIMULATION OF LENTICULAR NATURAL GAS FORMATIONS

REFERENCE TO RELATED APPLICATION

This application claims the benefit of U.S. Provisional Application No. 60/057,202, filed Aug. 26, 1997.

FIELD OF THE INVENTION

The present invention relates to the stimulation of production from natural gas reservoirs that are characterized by lenticular gas-bearing formations. More specifically, the invention relates to production optimization using ball sealers for multi-stage fracturing of properly spaced wells and perforated zones.

BACKGROUND OF THE INVENTION

Hydraulic fracturing is a well-known technique for stimulating production from subterranean hydrocarbon-bearing formations. In a typical operation, an interval of a wellbore adjacent to a formation is perforated and fracturing fluid is pumped into the formation at a pressure sufficient to fracture the formation both laterally, away from the wellbore, and vertically, along the length of the wellbore. Propping agents such as sand or bauxite are usually mixed in with the fracturing fluid in order to enter the fractures and maintain them open once the pressure is reduced. This treatment enhances the productivity of the formation and thereby increases hydrocarbon production rates.

Hydraulic fracturing has been successfully employed in many types of hydrocarbon formations, particularly low permeability reservoirs which require stimulation to accelerate production to flow rates which make the reservoir economic to develop. Occasionally, conventional fracturing techniques have to be modified to stimulate a reservoir. For example, some reservoirs have many hydrocarbon bearing formations that are vertically stacked along the length of the wellbore and which are separated by essentially impermeable, non-hydrocarbon bearing formations. Techniques have been developed which permit successive fracturing of each of the formations. Temporary means are used to seal off the perforations adjacent to one formation that has been fractured while a subsequent fracture treatment is conducted at a different depth in the same formation or in another formation. Mechanical devices such as bridge plugs and packers have been used to separate treatment zones, and more recently, multi-zone fracturing using inexpensive ball sealers has been employed.

Although hydraulic fracturing technology has progressed to where many low permeability hydrocarbon formations can be economically produced, there are certain types of natural gas reservoirs which continue to defy economic fracturing exploitation; specifically, reservoirs which are characterized by discontinuous lenticular gas-bearing sand deposits of limited areal extent. These lenticular sands are also frequently "tight" which means they are characterized by low or very low permeability. Prime examples of such tight gas reservoirs are the various basins in the Rocky Mountain region of the western United States (Greater Green River, Piceance, Wind River and Uinta) which contain numerous lenticular, tight gas sandstones within thick formations. These four basins have been judged to be the largest undeveloped gas resource in the United States, containing as much as 227 trillion cubic meters (8,000 TCF) of recoverable gas. These enormous gas reserves remain substantially undeveloped because no economic method for developing these reserves has heretofore been developed.

Much attention has been directed at fracturing techniques for developing formations having tight, lenticular gas deposits. Because of the enormous reserve base of potentially recoverable gas, a significant amount of research has been performed by the U.S. Department of Energy, government and private research laboratories, universities and the private sector in an attempt to develop fracturing technology to economically exploit lenticular formations. To date, these efforts have been largely unsuccessful.

The approach initially attempted to access tight lenticular formations was nuclear stimulation. Under this program nuclear explosive devices were detonated within large diameter wellbores to generate a large zone of dendritic fractures in the zone surrounding the detonation. The largest such experiment was the nuclear detonation in a lenticular gas formation near Rio Blanco, Colo., equivalent to 90 kilotons of dynamite. In addition to the obvious environmental, health and safety concerns associated with nuclear stimulation, such experiments were not successful in releasing significant volumes of gas reserves. The lack of control over the explosive fracturing and the subsequent closure of the dendritic fractures caused the nuclear stimulation projects to fall far short of expected gas stimulation results.

In the early 1970's the next approach chosen to stimulate tight gas lenticular formations was a new process, termed massive hydraulic fracturing (MHF), which envisioned creating very long fractures up to 1.6 kilometers (one mile) or more in length using very large volumes of fracturing fluid and proppant. Under the sponsorship of the Department of Energy, a joint industry consortium tested MHF treatments in the Rio Blanco region. To illustrate this project, one fracture treatment injected 398,250 kg (878,000 lbs) of sand proppant into one 28 m (91 ft) section of the formation during an MHF experiment. Even though this MHF generated a dynamic fracture length of about 564 m (1,850 ft) and a propped fracture length of about 267 m (875 ft), the resulting stimulated gas rate was only 3,880 standard cubic meters/d (137 kscf/d) after 30 days of production. (As used herein the term dynamic fracture length means the length of one wing of a bi-winged fracture from the wellbore to one of the tips created by the fracturing fluid while the terms propped fracture length or simply fracture length is that distance from the wellbore reached by the proppant.) Five zones were stimulated during the Rio Blanco experiment with various sizes of MHFs. Stimulated production levels were disappointingly low, usually less than 5,600 $m^3$/d (200 kscf/d), with the highest observed post fracture production rate being about 6,230 $m^3$/d (220 kscf/d); well below the desired flow rate of about 42,500 $m^3$/d (1,500 kscf/d) after one year of production, which is needed to achieve economic production for the wells in question.

Unrelated to the Rio Blanco project, in the late 1970's enhancements in multi-stage fracturing were achieved in stimulating lenticular heavy oil formations [*Stimulation of Asphaltic Deep Wells and Shallow Wells in Lake Maracaibo, Venezuela*, World Petroleum Conference 1979, Bucharest, Romania, P.D. 7(1)(the "WPC paper")]. These enhancements were achieved using ball sealer diverters. The WPC paper teaches that completing the wells with limited perforation intervals enables each stage of fracturing to open an independent fracture which is in communication with only one set of perforations. It was found that each stage of fracture treatment opened about 30 vertical meters (100 ft) of zone. Using low perforation shot densities of about three shots per meter (1 shot per foot) over 3 m (10 ft) combined with proper time release of the ball sealers permits stimulation of all of the oil sands penetrated by a given well. Although the WPC paper discusses multi-stage fracturing of heavy oil lenticular formations, it does not address methods or techniques for controlling fracture propagation in relationship to the size, distribution and placement of the oil sands. Because these oil sands have high permeabilities in the 1–100 mD range, their stimulation does not closely correspond to stimulating production from tight gas reservoirs characterized by lenticular deposits such as sand lenses. In fact, the WPC paper suggests that greater stimulation of the oil sands could be gained from longer fractures if an inexpensive, highly permeable proppant was used as an alternative to sand. However, as noted above, very long MHF fractures failed to achieve desired results in lenticular sand, tight gas reservoirs.

The failure of the Rio Blanco project led to the Multi-Well Experiment project (MWX) in the 1980's that explicitly studied hydraulic fracture shapes and flow capacities in an attempt to enhance gas stimulation benefits. MWX consisted of three wellbores placed about 46 m (150 ft) apart at total depth so that two of the wellbores could be used for close observation and monitoring of fracturing treatments done in the first wellbore. Most of the fracturing injections into the MWX wells were small to moderate in size so that the monitoring wells could sense signals from the entire fractured region. (For example, in one experiment the propped fracture length was only about 65 m (214 ft).) This work led to the conclusion that there was nothing inherently wrong with the hydraulic fractures formed in these tight gas sands, i.e., fracture lengths, widths, and heights were the expected size.

The MWX project was followed at the same site by the M-Site project that continued the measurement of hydraulic fracture parameters until the end of 1996. During this entire time, efforts have been directed at advancing existing technology to more economically exploit the Rocky Mountain lenticular sands. As described in SPE Paper 35,630 [*Advanced Technologies for Producing Massively Stacked Lenticular Sands*, Apr. 28, 1996], advanced stimulation techniques and the intersection of natural fractures, coupled with intensive infill well development, can enhance the prospects of commercial production from tight lenticular sands. This paper suggests separating the lenticular sands encountered by a well into a series of packages of 91 to 152 m (300 to 500 ft) of gross interval. In $610^{+}$ m ($2000^{+}$ ft) of saturated gas zone for a typical well there would be four to seven such packages. The analysis in this paper concludes that completing wells in multiple zones correlates strongly with increases in production.

As to infill well development SPE 35,630 suggests that closer well spacing will increase total gas recovery, noting, for example, that at 40 acres per well 12 out of 16 wells would still penetrate separate sand bodies, i.e., no or limited interference or communication with the sands of an adjacent well. This limited interference occurs because the average areal extent of the lenticular sands in communication with the wells reviewed in SPE 35,630 is only about 22 acres. However, even with multiple zone fracturing and infill drilling, wells drilled with 40 acre spacing still would have a recovery efficiency of gas in place of only about 26%. Thus nearly three fourths of the original gas in place would remain unrecovered using the approach suggested in SPE 35,630. Although the SPE paper suggests well spacing down to 20 acres might further enhance recovery, it fails to disclose methods for controlling the stimulation techniques to capture larger quantities of the original gas in place or the relationship between the stimulation technique and the spacing of the wells. Therefore, what is needed is a well stimulation method for substantially enhancing production from reservoirs characterized by tight gas, lenticular deposits such that they become commercially exploitable gas fields.

SUMMARY OF THE INVENTION

This invention is directed to a method for stimulating production from wells drilled into reservoirs characterized by lenticular gas-bearing deposits. The wells are perforated in a plurality of single-stage zones that are spaced along the thickness of the reservoir. Preferably, the reservoir thickness through which the wells are drilled and perforated is divided into multiple multi-stage zones which have two or more of the single-stage zones. The wells are then fractured with the fracturing occurring in multiple stages such that the single-stage zones (within a multi-stage zone) are sequentially fractured; each fracturing stage being separated by ball sealers. The fracturing is controlled to create lateral fractures which will drain an area that approximates the average horizontal area of the lenticular gas bearing deposits in the vicinity of the multi-stage zones. In a preferred embodiment, the total length of the lateral fractures approximates the average diameter of the lenticular deposits.

In one embodiment of the present invention, a method is described for developing a reservoir characterized by lenticular gas-bearing deposits. In this embodiment each well drilled into the reservoir is perforated and fractured as described above. As the process of drilling, perforating and fracturing additional wells into the reservoir is continued, the wells are spaced such that the horizontal cross-sectional area in the reservoir surrounding each well is not less than the approximate average drainage area of the lateral fractures along the length of the well. In a preferred embodiment, the cross-sectional area in the reservoir surrounding each well roughly equals the approximate average drainage area of the lateral fractures along the length of the well. In a typical Rocky Mountain basin, the area surrounding the well would be between about 40,000 to 122,000 square meters (10 to 30 acres).

In another embodiment directed at reservoir development, the horizontal crosssectional area in the reservoir surrounding each well is not less than the approximate average cross-sectional area of the lenticular gas-bearing deposits and the lateral fractures are controlled to extend to the lenticular deposits in the vicinity of each well. For this embodiment, it is preferred to have the cross-sectional area in the reservoir surrounding each well roughly equal to the approximate average horizontal cross-sectional area of the gas bearing deposits. Once again, the typical area surrounding the well would be between about 40,000 to 122,000 square meters (10 to 30 acres). It would also be preferable in the embodiment if the approximate average drainage area of the fractures does not substantially exceed the average cross-sectional area of the lenticular deposits.

For all of the primary embodiments of the present invention described above, there are preferred methods for conducting the perforation and fracturing techniques. In perforating the wells it is preferred to perforate the single-stage zones in the approximate geometric center of the zones. For fracturing, the preferred fracturing fluid is a non-Newtonian fluid such as a cross-linked gelled water. It is also desirable to generate fracture heights that are approximately equal to the corresponding vertical length of the single-stage zones. Where fracture orientation is known, it is also preferred to have the total length of the fractures approximate the average length of the lenticular deposits, i.e., the horizontal distance across the lenticular deposits in the direction of the fracture orientation.

DETAILED DESCRIPTION OF THE INVENTION

The method of this invention enables the commercial development of natural gas reservoirs characterized by numerous, lenticular gas-bearing deposits within thick formations by substantially increasing the recovery of the original gas in place in the reservoir. The method employs a controlled ball-sealer multi-stage fracturing technique which is designed to match the well drainage area created by the propped fracture with the approximate horizontal area of the lenticular gas-bearing deposits. In a preferred embodiment of the invention, the number of wells drilled and fractured achieves well-spacing which is no less than the average approximate area of the gas-bearing deposits. It is contemplated that a natural gas reservoir fully developed using the method of this invention can potentially recover a major portion of the original gas in place during the expected commercial life of an individual well (10–15 years).

In the method of this invention the multi-stage fracturing technique is essential to maximizing exploitation of the gas reservoir. Although the method is primarily directed at achieving economic production from tight lenticular gas sands typically found in the Rocky Mountain region of the United States, it can also be employed to develop other types of gas-bearing deposits having similar characteristics. For example, coal seams containing coal bed methane could also be exploited by the method of the present invention. Virtually any natural gas reservoir in which the natural gas is trapped in stacked, discontinuous sediments that are distributed throughout the formation can be developed by the method of the invention. Thus as used in this specification and in the claims, the term "lenticular" refers to any discontinuous sediment, pocket, layer or deposit containing natural gas and not just the lens-shaped, fluvial sands that typify the Rocky Mountain basins.

The term "reservoir" is also used broadly in both the context in which it is generally used in the oil and gas industry but also in the context of a target area of exploitation. For example, a reservoir may be a portion of a larger reservoir on which mineral leases are held or it may represent the "sweet spot" within a reservoir where the gas reserves may be most economically exploitable. Alternatively, a reservoir may contain a number of discrete hydrocarbon deposits grouped in relatively close proximity to each other, such as the lenticular gas sands described above, whether or not such deposits are of comparable geologic origin. For the purposes of the present invention the term "reservoir" is intended to mean any subterranean gas deposits or portions thereof which are to be developed.

Figure 1:
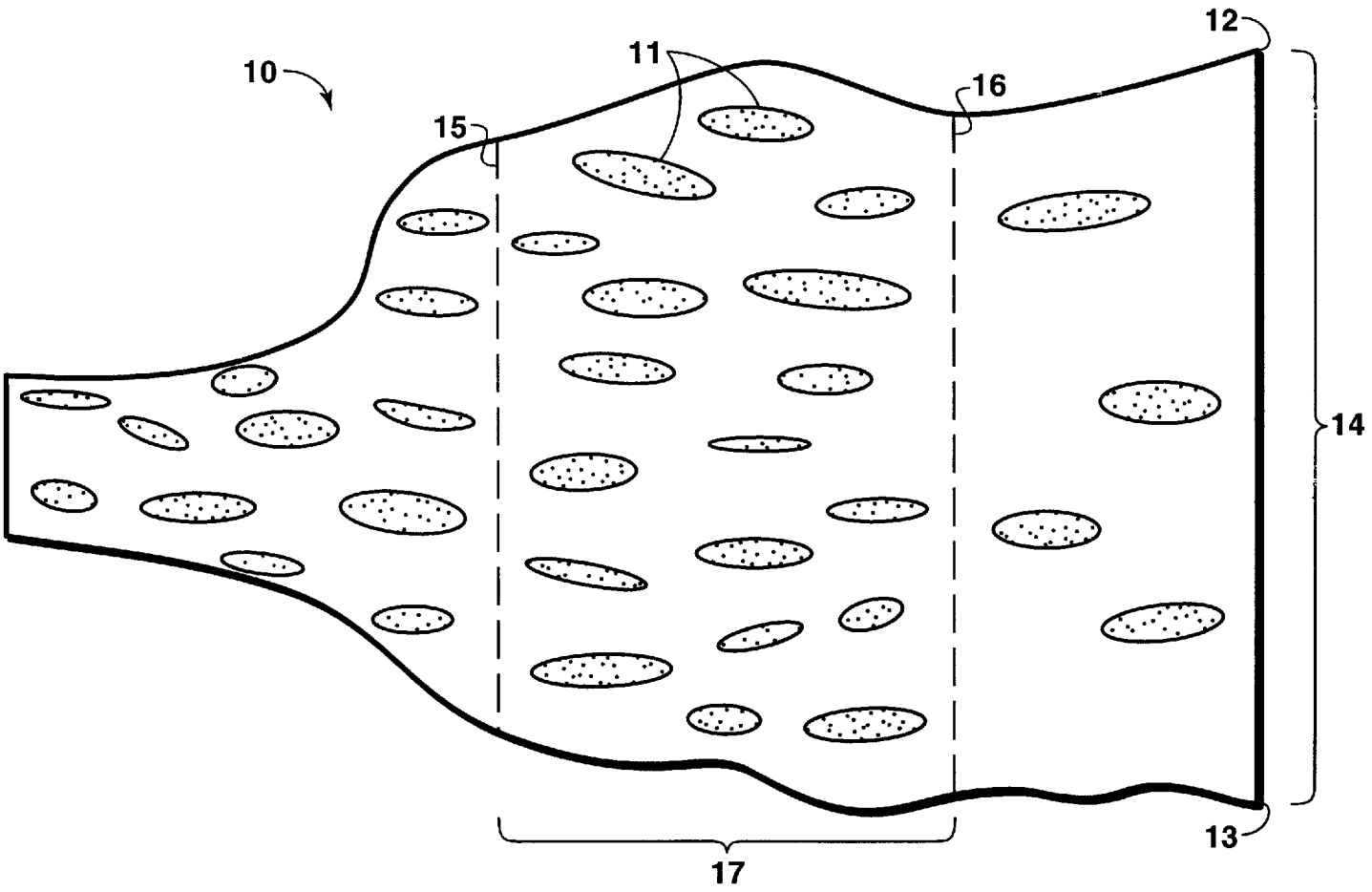
FIG. 1 is a schematic vertical cross-section of a subterranean natural gas reservoir containing deposits of lenticular sand lenses.

Referring more particularly to the drawings, FIG. 1 illustrates a vertical cross section of a natural gas reservoir 10 containing deposits of typical stacked lenticular sands 11 found around the world. The sand lenses 11 are of different shapes and sizes and have different orientations within reservoir 10. The combination of the shifting meanders of the ancient river beds from which they were formed and geologic uplift created the widely scattered array of discontinuous sand lenses. The upper boundary 12 and lower boundary 13 of the reservoir define the thickness of the reservoir typically 150 m to 1,220 m (500 ft to 4,000 ft). In the Piceance, Green River, and Uinta basins of the Rocky Mountain region, the upper boundaries of these reservoirs are typically found at depths of from about 1,830 m (6,000 ft) to 3,050 m (10,000 ft) below the surface. Thus these reservoirs are at moderate depths compared to other natural gas formations around the world. However, these are very thick reservoirs with stacked lenticular sands being scattered over a thickness 14 that generally exceeds 914 m (3,000 ft) and typically is about 1,220 m (4,000 ft).

Also shown in FIG. 1 are imaginary boundaries 15 and 16 which define the "sweet spot" of the total reservoir which has been selected for exploitation by the present invention. As shown in FIG. 1, this portion 17 of the reservoir has more lenticular sands than the portions outside boundaries 15 and 16. The portion to the left of boundary 15 has a high density of lenses but is not nearly as thick as portion 17. The portion to the right of boundary 16 is thick but does not have a sufficiently high lens density. Alternatively, the portion of the reservoir between 15 and 16 may be selected because the sands within it have higher permeability, better porosity, higher gas saturation, larger lens size, or other characteristics which make it more suitable for development. (Surface terrain, mineral lease boundaries and other non-reservoir factors may also restrict the portion of the reservoir accessible for development.) The method of the present invention will be directed at the reservoir bounded by the upper and lower boundaries 12 and 13 and the lateral boundaries 15 and 16.

Figure 2:
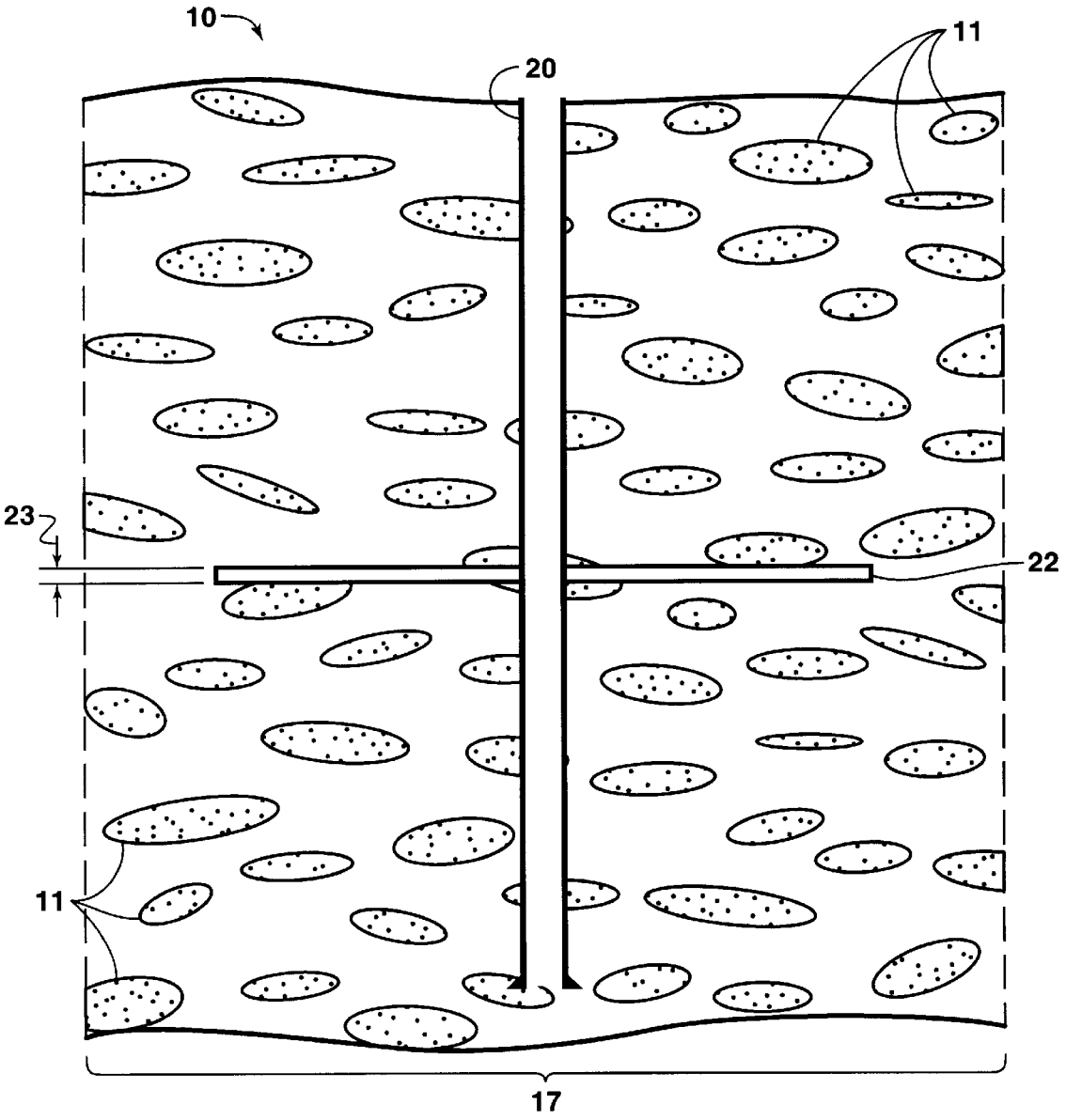
FIG. 2 (PRIOR ART)
FIG. 2 is a schematic vertical cross-section of a wellbore and a fractured interval of a natural gas reservoir.

FIG. 2 illustrates how the reservoir might have been exploited using massive hydraulic fracturing (a) techniques previously discussed in the description of the prior art. A single well 20 has been drilled into reservoir 10 and particularly the targeted portion 17 that is best suited for exploitation. The fracture 22, is typical of MHF fractures and laterally extends through most of the targeted reservoir area. This can be as much as 1,525 m (5,000 ft) from the wellbore and is typically at least 610 m (2,000 ft) in propped fracture length. However, as is the case with most MHF fractures, the vertical height 23 of the fracture 22 is only on the order of about 30 m (100 ft).

This result is generally desirable for most conventional gas reservoirs because the productive gas-bearing sediments are usually relatively thin, continuous, horizontal layers of sandstone which the MHF fully accesses both vertically and laterally. Thus the fracture is able to stimulate a large portion of the productive sand. However, as shown in FIG. 2, the MHF of a stacked, lenticular sand reservoir results in the fracture only intercepting a small percentage of the productive sand lenses 11. This is because the vertical fracture height 23 extends only about 30 m (100 ft) in contrast to the 1,220 m (4000 ft) thickness of the reservoir over which the lenticular sands are dispersed. Thus most of the sand lenses 11 in reservoir 10 are not stimulated by the MHF process.

In contrast to MHF, the multi-stage fracturing system incorporated in the present invention accesses a major portion of the productive sands within the drainage radius of the well. As will be discussed later, when coupled with the well spacing system disclosed herein, the multi-stage fractures of all of the drilled wells in the reservoir (or targeted portion thereof) will intercept the majority of the lenticular sands in the reservoir.

Figure 3:
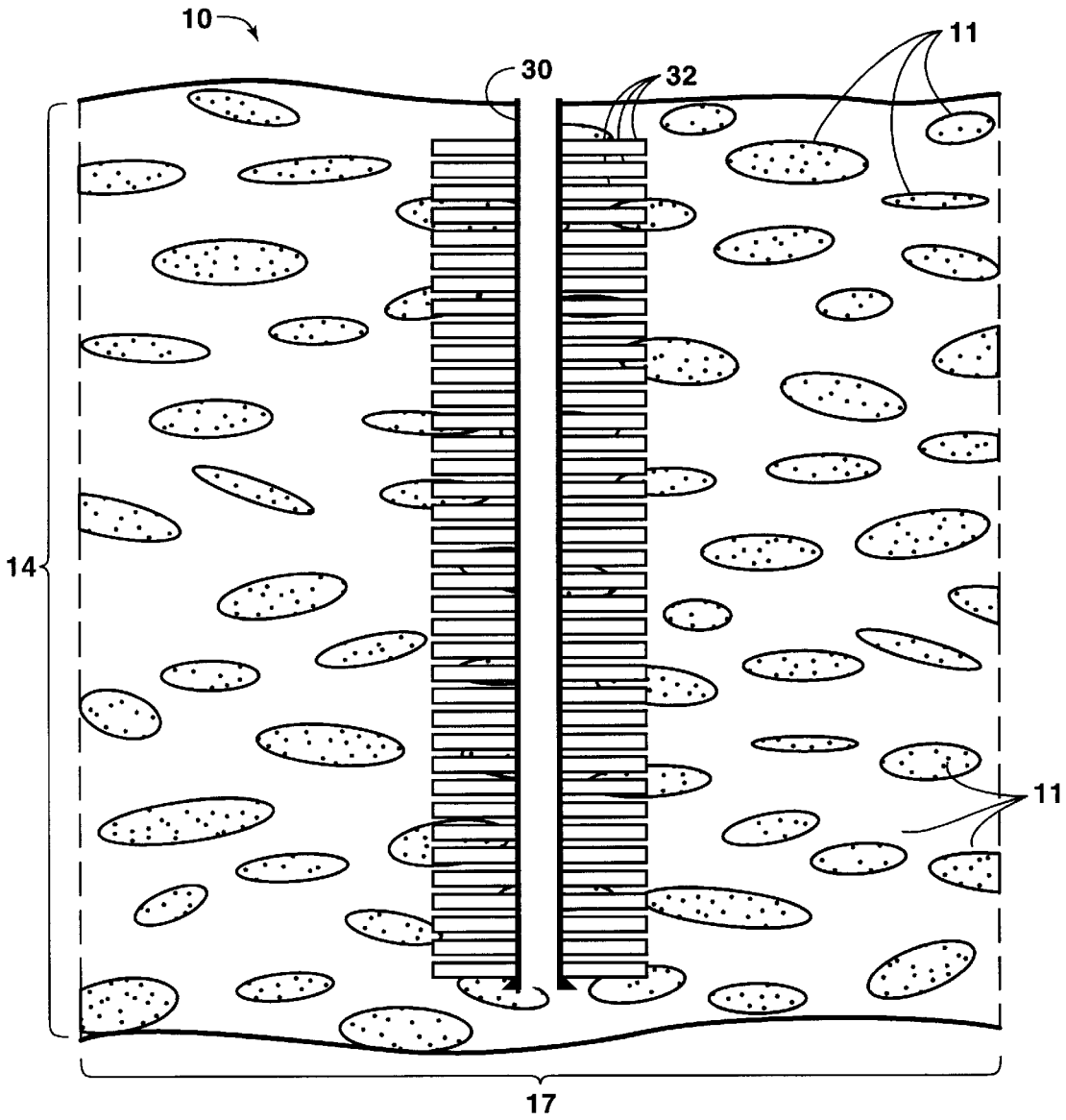
FIG. 3 is a schematic vertical cross-section of a wellbore and a natural gas reservoir that has been fractured using the method of the present invention.

FIG. 3 illustrates a multi-stage fractured well drilled into the same location of the portion 17 of the reservoir 10 where the MHF well of FIG. 2 was drilled. The controlled multi-stage fracturing used in the present invention generates a uniformly distributed series of bi-wing fractures 32 along the entire thickness of the target reservoir. Those skilled in the art will understand that the fractures 32 extending from well 30, as shown in FIG. 3, are illustrative and that in actual fracturing applications there may be more fractures with different shapes extending radially outward from the well and that the fractures may have wings with different lengths. Moreover, the fractures at one depth may or may not be aligned with those at other nearby depths. Nevertheless, the present invention attempts to generate the fractures as uniformly as possible and FIG. 3 represents an idealized outcome of that process. Unlike the MHF technique, the fractures are not located to intercept a particular producing sand or sands. Instead the fractures are spaced apart by approximately equal distances, the distance between each fracture representing the vertical height of the fracture. The vertical fractures in the multi-stage well 30 have about the same vertical height as the very long fractures in the MHF well. Thus, as was the case with the MHF well, these fractures typically have a vertical height of about 30 m (100 ft).

Where the multi-stage fractures are substantially different from the MHF well is the propped fracture length. By controlling the amount of fracturing fluid and proppant for each stage, the length of fracture 32 will drain an area that approximates the average horizontal area of the lenticular sands 11 typically found in the reservoir in the vicinity of the wellbore. In other words, the distance covered by the extent of the fracture (both wings) that extends laterally outward from the wellbore (the lateral fracture) preferably approximates the average diameter of the lenticular sands. Therefore, in contrast to the very long MHF hydraulic fractures, the multi-stage fractures are relatively short.

The overall effect of numerous short, uniformly spaced fractures along the thickness of the reservoir is depicted in FIG. 3. As FIG. 3 illustrates, the fractures 32 intercept a major portion of the lenticular sands 11 that are in the vicinity of the wellbore. Because the fractures extend uniformly down well 30 through the entire thickness 14 of reservoir 10, they are highly effective in recovering a large percentage of the gas trapped in the lenticular sands. To compare potential recoveries, a typical Piceance basin MHF well previously described in FIG. 2 will likely drain about 0.57 million cubic meters (0.20 to 0.30 Bcf) over the life of the well. In contrast, a single multi-stage fractured well shown in FIG. 3 drilled into the same location of the reservoir would likely recover in excess of 10 times more gas.

Although the OF well has only one long fracture in contrast to the approximately 30–50 fractures of the multi-stage fracture well, the MHF well often consumes more proppant in generating and propping open its single fracture. For example, a MHF well of the type illustrated in FIG. 2 would use up to about 0.91 million kg (3 million lbs) of sand proppant whereas the multiple fractures of the multi-stage fracture well on 15 acre spacing would consume only about one third that amount of proppant.

Another preferred embodiment of the present invention is directed at modifying fracture length based upon the relationship of the orientation of the fractures and the orientation of the sand lenses in the reservoir. As noted above, the base approach is to generate total fracture lengths which approximate the average diameter of the lenticular sands found in the reservoir. However, sand lenses are generally not circular in cross section, i.e., in the shape of a round lens. Because their geologic derivation are fluvial sands from the bends of ancient rivers, the lens shape may be elliptical or rectangular, with a much longer length than width. (Other, more complex shapes, such as horseshoes or boomerang shapes, are also possible.)

Figure 4A:
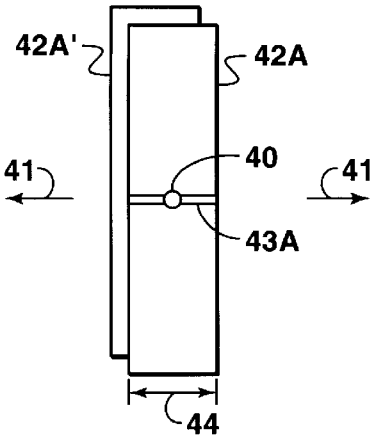
FIGS. 4A–4E are a series of schematic plan views of three cross-sections, a fracture and two sand lenses, penetrated by a wellbore which depict various embodiments of the present invention.
Figure 4B:
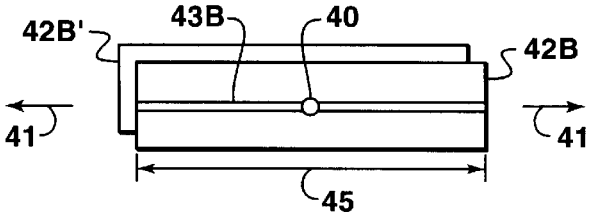

FIGS. 4A through 4E illustrate various combinations of sand lens and fracture orientations and how fracture length may be optimized based upon these orientations. (In general, in a hydraulically fractured tight gas lens, the areal drainage pattern of the fracture has an elliptical shape with the bi-wing fracture along the major axis of the ellipse. The discussion which follows can be best understood with this drainage pattern in mind.) For the purpose of simplification, only a top view of two overlapping sand lenses (i.e., at different depths) are depicted in the figures, each being rectangular in shape with a length equal to four times the width. The wells 40 are centered within the sand lenses and the fractures all have the same orientation 41 (left-right). (Fracture orientation will generally align in a direction that is perpendicular to the minimum principal stress of the formation although other factors may also influence direction.) FIG. 4A illustrates a situation where the two sand lenses 42A and 42A' are aligned and are perpendicular to the fracture orientation 41. Because of this orientation it is preferable to limit the propped fractures 43A to a length (i.e., the bi-wing fracture length) that approximates the width 44 of the sand lenses. Fractures any longer than width 44 would penetrate non-productive formation and would not recover any additional gas. FIG. 4B shows the sand lenses 42B and 42B' in the same parallel alignment with fracture orientation 41. In this case it is desirable to generate longer bi-wing fractures 43B that traverse the entire length 45 of the sand lenses. These fractures would therefore have a desired length of four times the length of fractures 43A shown in FIG. 4A. Fractures 43B shorter than length 45 would not penetrate the entire sand lens and would not recover the maximum amount of recoverable gas.

Figure 4C:
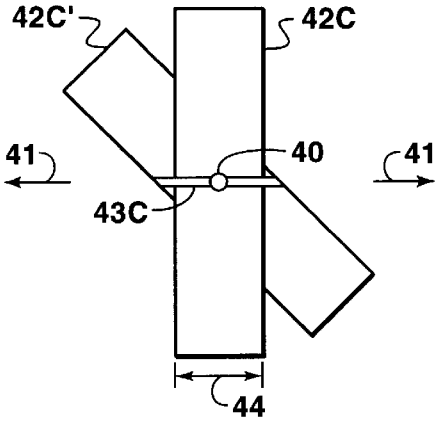
Figure 4D:
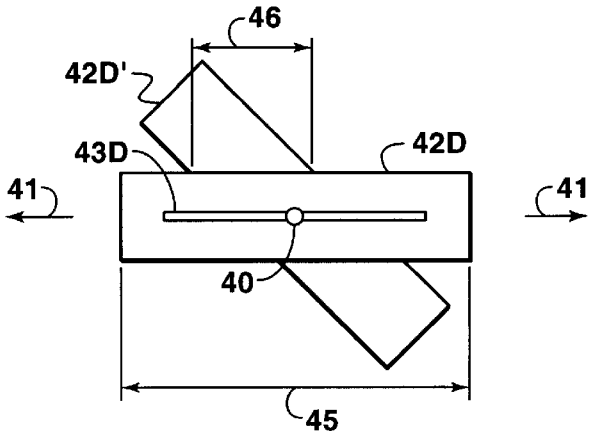

FIGS. 4C and 4D illustrate more probable scenarios where the sand lenses are not in alignment. In FIG. 4C, lens 42C is perpendicular to fracture orientation 41 but lens 42C' is at an angle 45° out of alignment with lens 42C. In FIG. 4D, lens 42D is parallel with fracture orientation 41 and lens 42D's is in the same orientation as lens 42C'. Determining the average distance across each lens along the direction of the fracture orientation yields the desired fracture length. For example, in FIG. 4D the average consists of the length 45 of sand lens 42D plus the diagonal length 46 traversed across lens 42D' by fracture orientation 41; divided by two. The calculated fracture length for fracture 43D is ¾ (0.75) of length 45. In the case of FIG. 4C, the fractures 43C calculate to 1.5 times width 44 (or 0.375 of length 45).

Figure 4E:
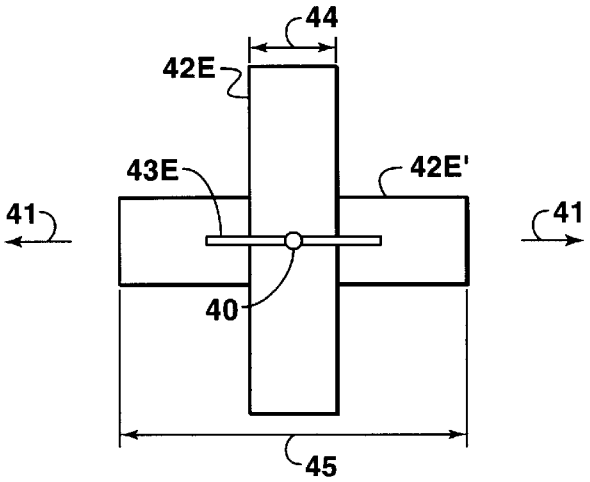

The final illustration, FIG. 4E, represents the two lenses 42E and 42E' that are perpendicular to one another, with one lens 42E being parallel to fracture orientation 41. In this example, the preferred length for fractures 43E is twice width 44 (or one half length 45). The outcome in FIG. 4E also reflects the fracture length which would be chosen if there were numerous sand lenses that had a random orientation; i.e., the fracture length is simply the average of the length and width of the typical sand lens. Also in situations where minimal information may be known about lens orientation (e.g., when the first well is drilled), one skilled in the art would select a fracture length that best approximates the average lens size. As more information is gathered about lens orientation (e.g., additional wells drilled) the calculation of fracture length can become more refined and tailored to the types of situations depicted in FIG. 4.

Those skilled in the art will also understand that the sand lenses will generally not be neatly centered around the wellbore as illustrated in FIG. 4. In most situations, the sand lenses will be off center. (See, for example, how sand lenses 11 are depicted in FIGS. 1, 2 and 3.) For example, if the wellbore 40 in FIG. 4B was further to the right (i.e., off center but still aligned with fracture orientation 41) then fracture length 43B would not traverse the entire length of the sand lenses 42B and 42B's to the left of the wellbore and would extend beyond the sand lenses into unproductive formation to the right of the wellbore. Nevertheless, the fracture would intersect a substantial portion of the lens and the lens would be effectively drained.

The point of this discussion is to demonstrate that even with substantial knowledge of lens and fracture orientation, the selection of a total fracture length is still, at best, an approximation. Thus in the practice of the present invention all references to fracture length, drainage area, sand lens size, well spacing and the like are intended as rough approximations that are subject to a wide range of variability. Those skilled in the art will be able to most effectively practice the present invention by working from pre-existing seismic and reservoir information plus data and analyses that are generated as the reservoir is developed. In other words, there is expected to be a learning curve from reservoir development which will enable skilled practitioners to optimize the application of the present invention for specific basins and reservoirs.

The technique employed in the present invention for multi-stage fracturing uses ball sealers to divert a fracturing fluid through the targeted perforations. Preferably the frac fluid is a non-Newtonian fluid such as cross-linked, gelled water. Other non-Newtonian fluids such as carbon dioxide foam or Newtonian fluids such as oil or water could also be employed to fracture the well. However, cross-linked, gelled water is preferred given the lower costs, simplicity, and fluid properties that minimize problems with ball sealer migration upward (buoyant) or downward (non-buoyant) in the pad stage where the balls are dropped. The technique employs ball sealers to sequentially seal off perforated intervals between stages because ball sealers can be deployed much more rapidly and efficiently than mechanically isolating each interval. For example, using ball sealers allows the well to be fully stimulated in about 4 days rather than the 40 days it would take to accomplish the same result using costly mechanical isolation means.

Figure 5C:
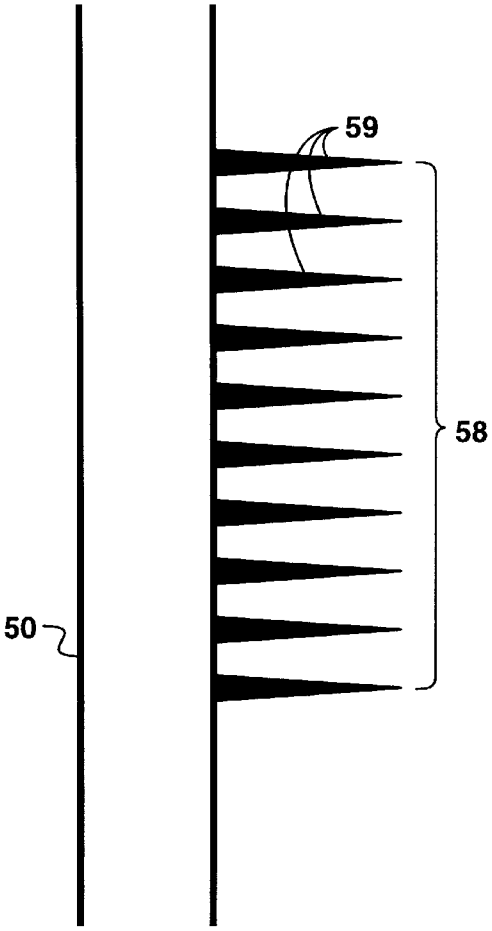
FIGS. 5A–5C are a series of schematic vertical cross-sections of a wellbore casing perforated in accordance with the method of the present invention.

The next sequence of figures describe the well completion and stimulation technique that is preferably employed to practice the present invention. FIGS. 5A through SC illustrate the perforation locations in the well that are needed before fracturing commences. Starting with FIG. 5A, the wellbore casing 50 is shown penetrating the entire thickness 52 of the reservoir. The discontinuity 53 indicates that most of the wellbore is not shown; only the uppermost and lowermost portions being depicted. In the example shown, the reservoir has a total thickness of 1,220 meters (4,000 ft) and is divided into multi-stage zones, each zone having a thickness of about 305 m (1,000 ft). FIG. 5A shows the top zone 54 and the bottom zone 55 of the well. These zones are referred to herein as multi-stage zones and they reflect the practical limitation on the number (about 10) of ball sealer stages that can be usually conducted in a single day of treatment. Thus, to treat all 1,220 m (4,000 ft) of reservoir would require four multi-stage (10 stages) jobs done sequentially on the wellbore starting with the deepest zone 55 and progressing to the shallowest multi-stage zone 54. Each multi-stage zone is further subdivided into smaller intervals of about 30 m (100 ft) each of which is referred to herein as a single-stage zone. Intervals 56A–J associated with multi-stage zone 54 and intervals 57A–J associated with multi-stage zone 55 shown in FIG. 5A are single-stage zones.

Figure 5B:
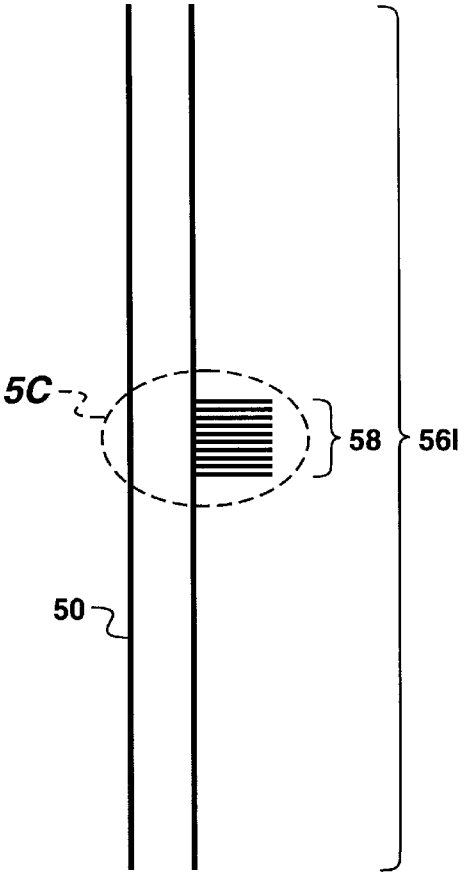
Figure 5A:
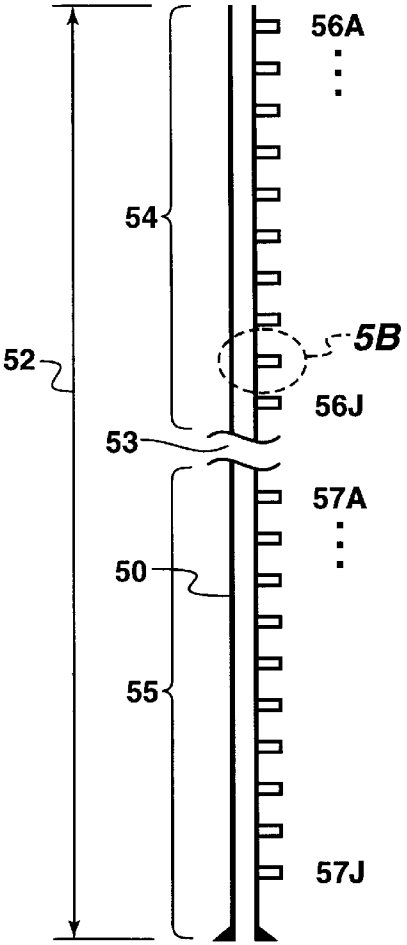

A single-stage zone, 56I, is enlarged and shown in FIG. 5B. A 3 m (10 ft) perforated interval 58 is selected as the location within interval 561 to be perforated. The perforated interval height is preferentially placed at the approximate geometric center of each single-stage zone, but is not restricted to exactly that location. When actual sand lenses are located within 3 to 6 m (10 to 20 ft) of the preferred center location of the perforated interval height, the perforated interval height can be moved to center on that nearby sand lens. Although advantageous to have perforation holes approximately opposite a sand lens location when possible, it is not necessary to have the perforations at such a location for the application of this invention. Movement of the location of the perforated interval height more than 6 m (20 ft) from the preferred location can jeopardize the ability of the ball sealers to efficiently generate single-stage fracture heights that do not substantially overlap. Although some overlap of fracture heights may occur without being detrimental to the practice of the invention, it is preferred that such overlap be minimized. FIG. 5C further enlarges the perforated interval 58 of the wellbore to illustrate the location of the perforations 59 to be made within interval 58 and which penetrate wellbore casing 50. FIG. 5C illustrates perforations 59 spaced apart by about 0.3 m (1 ft) along interval 58 which is typically 3 m (10 ft); i.e. 10 perforation shots in vertical alignment along the casing within a 3 m (10 ft) perforated interval. When viewed in its entirety in FIG. 5A, the wellbore casing has been perforated in 30 m (100 ft) single-stage zones, the perforations being centered about midway within a 3 m (10 ft) perforated interval within each single-stage zone.

It is important to note that the selection of the perforation locations is mostly a geometric exercise that is only slightly influenced by the location of the lenticular sands in the formation. This approach is very different than most perforating jobs that precede hydraulic fracturing of a well. In perforating conventional wells the perforations are usually targeted to align with the productive formation sands of the reservoir. In the present invention the perforations are strategically spaced along the entire thickness of the reservoir, preferably being located in short perforated interval heights that are within equally spaced single-stage heights along the wellbore as shown in FIG. 5A.

The number of single-stage zones, their vertical extent, the height of the perforated interval within the single-stage zones and the number of perforations can be varied and the example depicted in FIGS. 5A–5C are illustrative of only one possible scenario. It is also possible that the length of the single-stage zones and perforated intervals and the number of perforations within a perforated interval can be altered within a single wellbore. The most important factor influencing these variables (single-stage fracture height, perforated interval height, and number of perforations) is the anticipated fracture height generated during the multi-stage hydraulic fracturing process. There are a number of factors influencing fracture height including the stress patterns in the reservoir and discontinuities such as slip zones and natural fractures which may occur in both the gas bearing lenticular sands and the non-productive formation rock in which the sand lenses are dispersed.

It has been found that most hydraulic fractures, regardless of the fracture length, generate fracture heights that are in the range of 15 to 60 m (50 to 200 ft). For many parts of the Rocky Mountain basins having stacked lenticular sands, a good rule of thumb is that fracture height will be approximately 30 m (100 ft). To generate such a fracture height, one does not have to perforate the entire anticipated height of the fracture. Instead it is preferable to only perforate the center portion of the fracture interval through which the fracturing fluids will enter. Therefore, as discussed in connection with FIGS. 5A–5C, a perforated interval spacing distance of 30 m (100 ft) was selected which was typical of the average fracture height anticipated for the reservoir. The selection of a 3 m (10 ft) perforated interval with 10 vertically spaced perforations would enable the fracturing fluid to efficiently propagate a vertical fracture spreading out from the center of the interval and traversing with the single-stage height out to the drainage radius.

Figure 6:
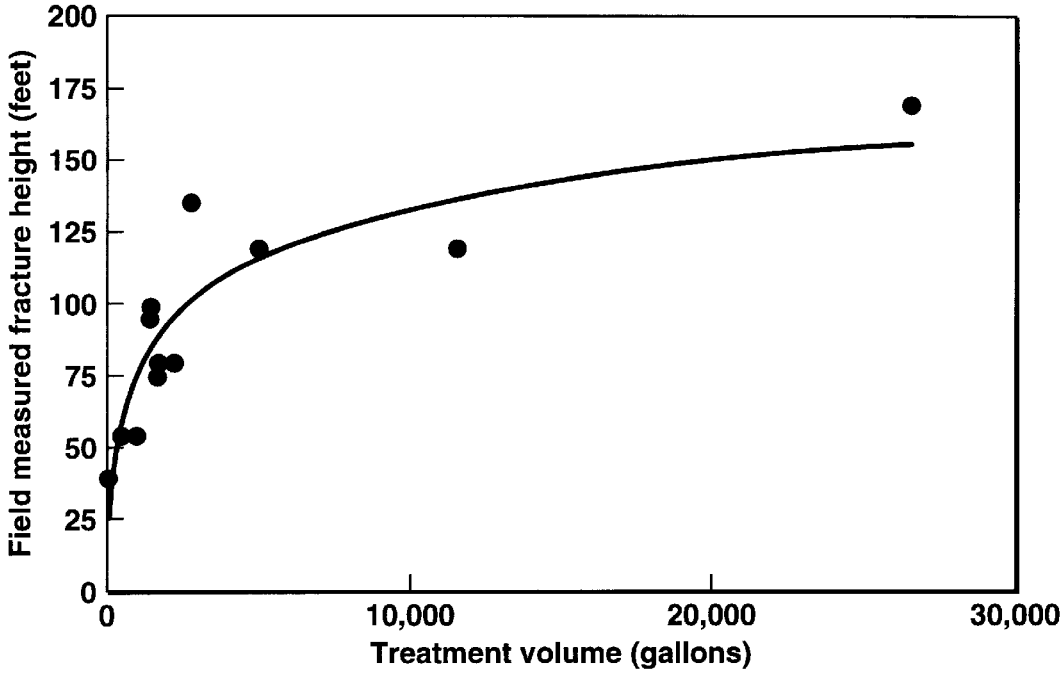
FIG. 6 is a graph of data plotting the correlation of fracture height versus treatment volume.
Figure 7:
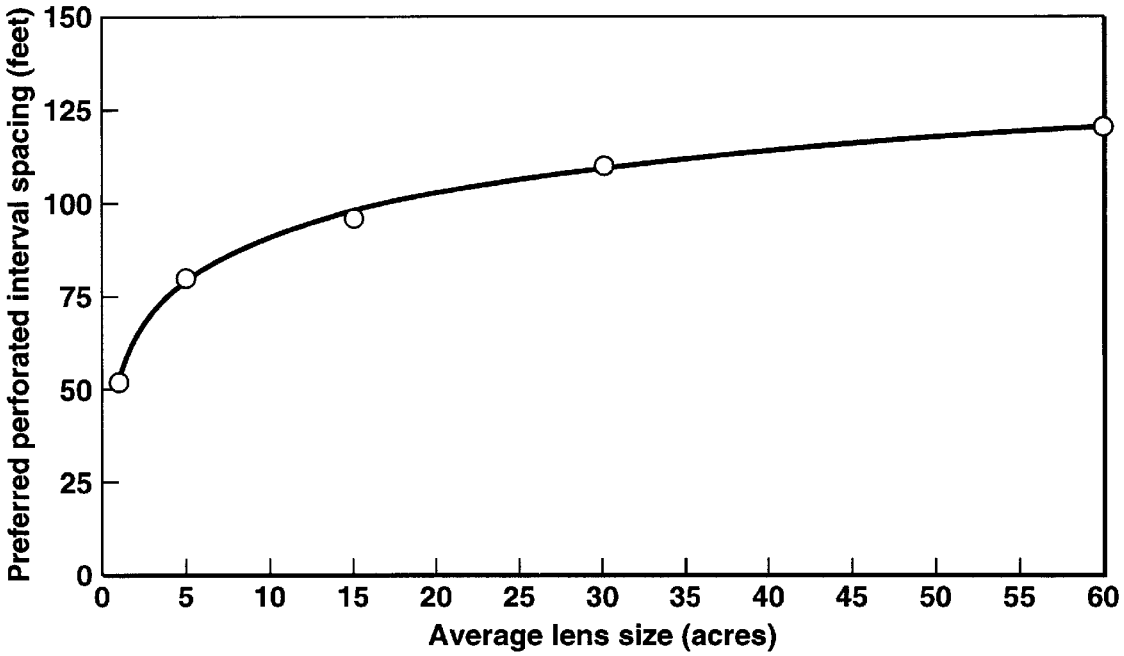
FIG. 7 is a graph of data plotting the correlation of perforated interval spacing versus average lens size.

The perforated interval spacing distance in general depends upon many reservoir and geological factors in a complex way, however there is a current field-derived correlation for the four Western Tight Gas basins previously discussed. Plotted in FIG. 6 are measured field fracture heights versus frac fluid volume injected which shows that in these basins fracture height increases with increased fluid volume. If the average lens size in connection with the wellbore is greater, more fluid volume must be injected to place a propped fracture to the drainage radius. This increases fracture height and correspondingly increases the preferred perforated interval spacing to maintain separate single-stage fracture heights. FIG. 7 is a correlation of the preferred perforated interval spacing distance versus the average lens size which is developed from the curve shown in FIG. 6. It is anticipated that once average lens size is determined in an area by logging, conventional reservoir interference testing, or other means, perforated interval spacing distance would be determined from a plot similar to FIG. 7 for the completion of nearby, new wells. FIG. 7 may not be specifically applicable to all areas in the Western Tight Gas basins and may not apply to other basins around the world. However, it is expected that the same methodology used to generate FIG. 7 would apply to other lenticular, gas-bearing reservoirs in the world with different input from those reservoirs equivalent to FIG. 6.

The process for controlling the fracturing of all of the intervals in the well involves the multi-stage fracturing technique using ball sealers. The multi-stage fracturing preferably starts with the bottom multi-stage zone in the reservoir and works its way up to the top multi-stage zone. (Recalling FIG. 5A, the bottom zone 55 would be the first fractured and the top zone 54 would be last.) The zone being fractured can be isolated from the deeper multi-stage zones in the wellbore that have been already fractured by placement of a sand plug (or mechanical bridge plug) inside the casing. Within each multi-stage zone, the single-stage zones are sequentially fractured until all intervals in the zone have been fractured. It is not necessary that the single-stage zones fracture in any particular order (for example, from top to bottom or bottom to top). In fact, the primary reason for selecting essentially equally spaced perforated intervals which each have the same number of perforations is so that it does not make any difference which order the single-stage zones are fractured. The technique then moves up the wellbore to the next multi-stage zone where all single-stage zones are also fractured and, so forth, until every single-stage zone is fractured.

Figure 8C:
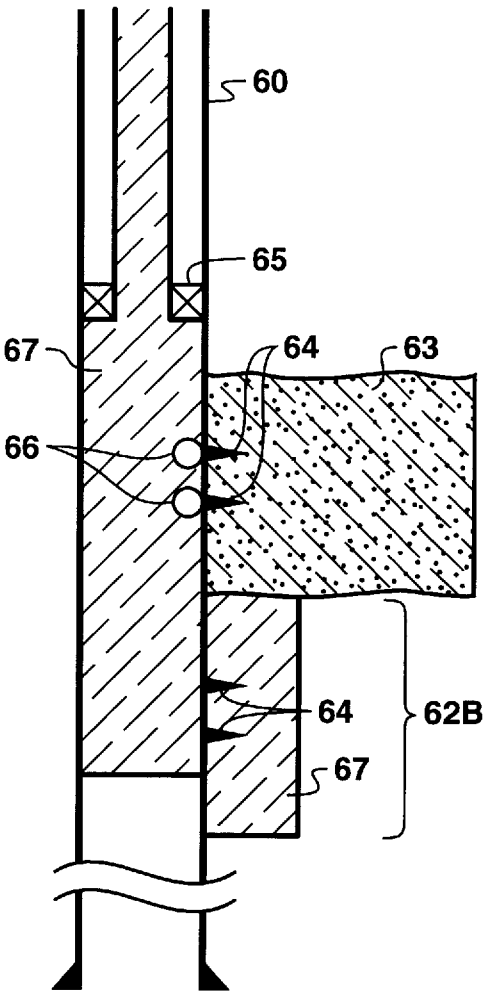
FIGS. 8A–8C are a series of schematic vertical cross-sections of a wellbore and a formation interval being fractured using an embodiment of the present invention.
Figure 8B:
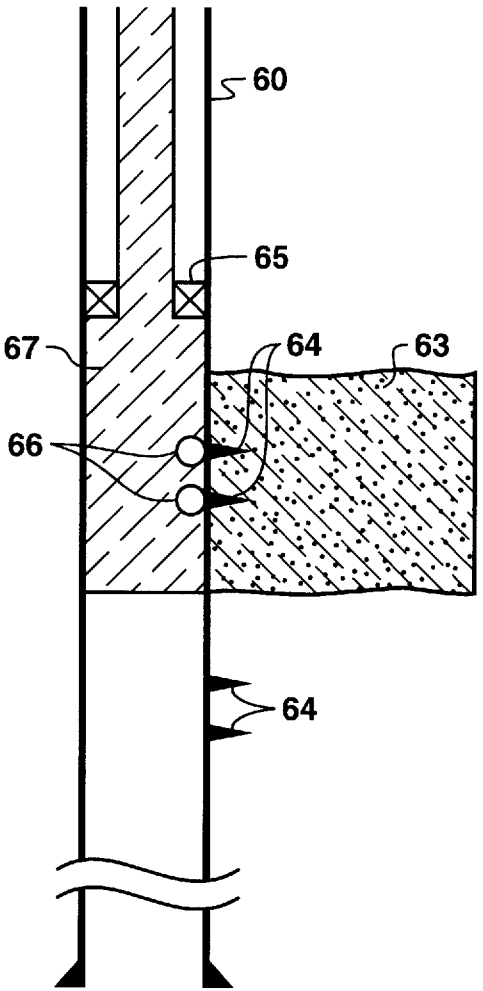
Figure 8A:
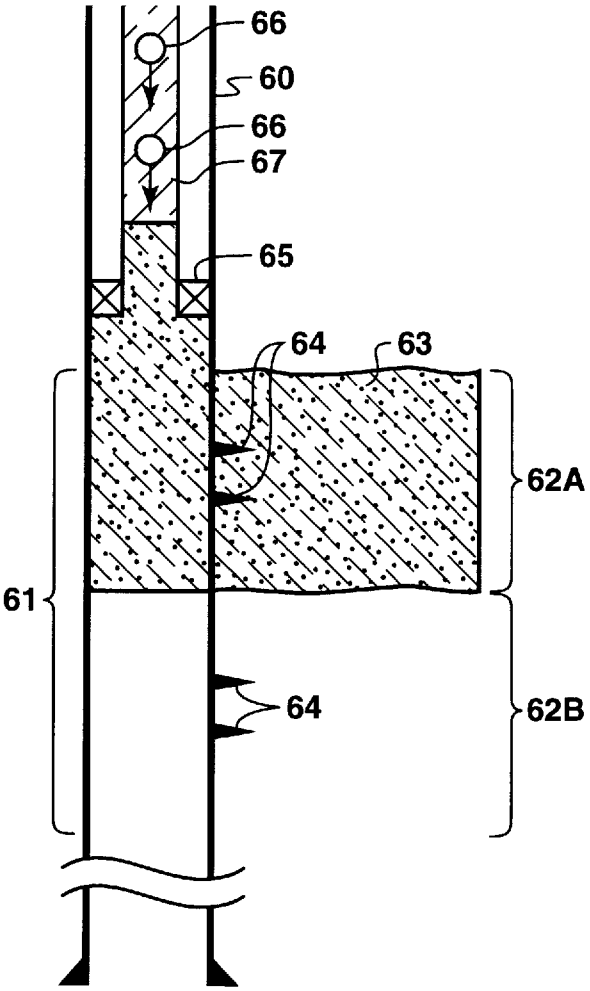

Within each multi-stage zone, fracturing from one single-stage zone to the next single-stage zone occurs in the manner shown in FIGS. 8A–8C. In FIG. 8A, fracturing fluid is injected into wellbore 60 and down to a single-stage zone 62A through tubing set on a packer 65 or alternatively without a packer with perforations 64 that are approximately centered on the single-stage zone. The fracturing fluid 63, preferably a non-Newtonian cross-linked gelled water containing proppant, enters the formation through perforations 64. Because the shallowest single-stage zone 62A within multi-stage zone 61 usually has lower stress than the deeper single-stage zone 62B, zone 62A is likely to fracture first as the injection pressure of the fracturing fluid increases. Although this is the most likely scenario, a different order of single-stage zone fracturing will not alter the effectiveness of the overall multi-stage, ball-sealer staging process described in this invention. Using procedures well known in the art, a proppant such as sand is carried by the frac fluid and injected into the fracture. The sand-laden fracturing fluid enters into the hydraulic fractures and serves to hold the fractures in an open position after the hydraulic pressure of the fracturing fluid is reduced and the fluid is recovered.

As shown in FIG. 8A ball sealers 66 are generally injected into the well in the pad stage after the end of the proppant-laden fracturing fluid of an individual single-stage zone so that they arrive at the particular single-stage zone being fractured at the correct time. Critical to making this part of the technique work is to drop the ball sealers at the correct time before or after the proppant-laden fluid stage 63. The balls, typically having a specific gravity of 0.9 to 1.5, may ascend (if buoyant) or descend (if non-buoyant) within the pad fluid and can arrive at the perforations too late or too early. If necessary, the injection time of the ball sealers is altered so as to have the balls arrive at the perforated interval of the single-stage zone at the right time. FIG. 8B shows the balls seated on perforations 64 in perforated interval 62A, having arrived at the correct time thereby sealing off that single-stage fracture zone. If the balls arrive too soon, they can seal the perforations before all the sand is injected, resulting in fracture initiation of a lower interval by sand-laden fluid. The result would be that the next stage of pad fluid pumped into the next single-stage zone would contain a small spearhead of proppant-laden fluid that would likely screen out that single-stage zone, preventing further treatment of the multi-stage zone.

By timing the ball sealer injection properly, as described above, the first single-stage zone in the multi-stage zone is sealed. Referring to FIG. 8C, after perforations 64 are sealed, a pad fluid 67 that does not contain proppant is injected which initiates the fracturing of the next single-stage zone (most likely interval 62B). The process is then repeated using proppant and timed ball sealer injection until that interval is fractured and sealed. Thus in a controlled multi-stage fracturing process each single-stage zone within each multi-stage zone is stimulated.

The fracturing technique is also controlled to limit the propped total fracture length. A specific volume of fracturing fluid and sand is injected into each single-stage zone. Instead of the 1.38 million kg (3 million lbs) of sand typical of MHF well injection, only about 11,340 kg (25,000 lbs) of sand are typically injected into the formation surrounding each single-stage fracture zone if the average sand lens size is approximately 15 acres. The entire well, having 40 fractured intervals consumes about 0.45 million kg (1 million lbs) of sand. The controlled propped fracture lengths have a radial distance away from the wellbore of about 122 m (400 ft) which laterally extends from the wellbore into the formation.

Figure 9:
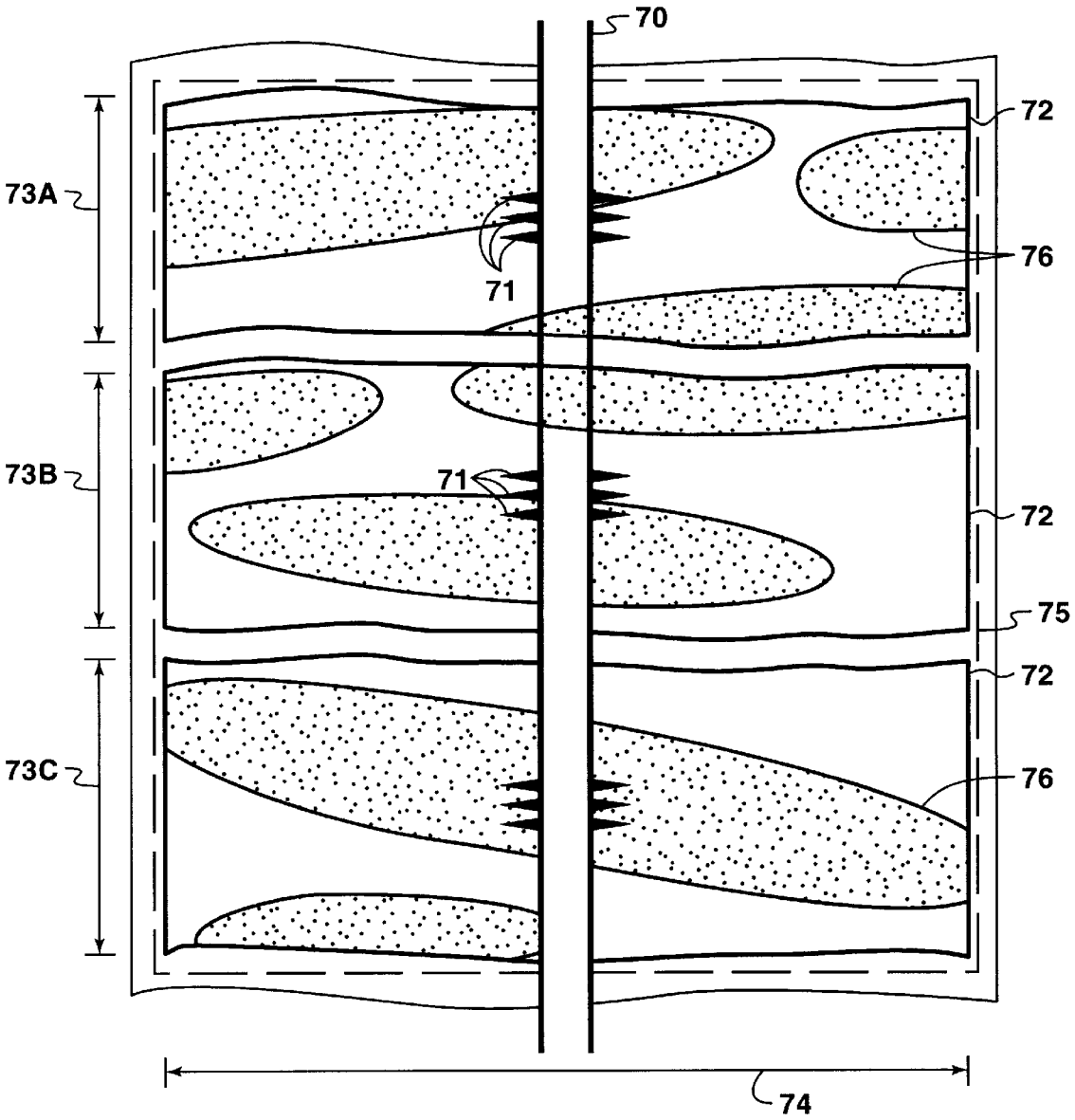
FIG. 9 is a schematic vertical cross-section and an interval of a formation that has been fractured using the method of the present invention.

The final outcome of part of a multi-stage zone that has been fractured is depicted in FIG. 9. Surrounding wellbore 70 are three single-stage zones which have been perforated (perforations 71) and successfully fractured with the multi-stage technique using ball sealers described above. Each of the single-stage fracture wings 72 extend laterally, approximately 122 m (400 ft) into single-stage fracture zones 73 A, B, and C; thereby opening to the wellbore, flow from a reservoir area having a horizontal area spacing of about 60,700 $m^2$ (15 acres). This lateral extent 74 of the bi-wing fractures reaches the approximate average area of the lenticular sands 76 contained in the reservoir. The single-stage zone's fracture height of about 30 m (100 ft) puts those sand lenses above and below the perforated interval height into communication with the wellbore, as shown by dotted line 75, that is within the formation surrounding the perforated interval.

After all fracturing operations are completed, a continuous span of hydraulically fractured reservoir formation extends through the entire thickness of the formation that surrounds the wellbore. This fracturing technique is intended to intercept and stimulate a major portion of the lenticular sands that are either intersected by the wellbore or within the drainage radius of the well. Gas trapped in these sands will therefore flow into the generated hydraulic fractures and cumulatively will produce a large volume of gas that effectively drains the lenticular sands.

The preferred method for practicing the present invention involves coupling the multi-stage fracturing technique with a system for locating and spacing the wells within the reservoir. Although the method of the present invention can be practiced by drilling a single well in a prime area of a reservoir where a large concentration of quality sands are present, the method is best practiced by drilling multiple wells which fully develop the entire reservoir or a substantial portion of it. The multi-stage fracturing technique generates lateral fractures that have an areal influence of about 40,500 to 121,400 $m^2$ (10 to 30 acres). Within this range the wells will effectively drain the adjacent and near-wellbore lenticular sands, i.e., the sand lenses in the vicinity of the well. Outside the fracture radius, the sand lenses will not be intercepted and will not be drained.

Figure 10B:
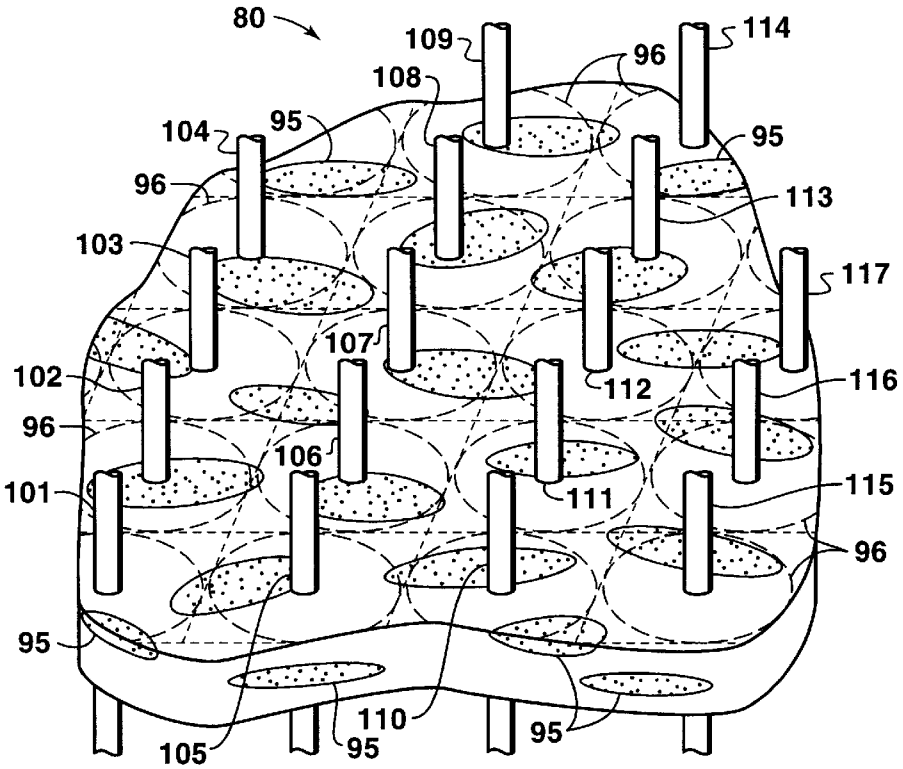
FIGS. 10A and 10B are two elevational views, partly in cross-section, of wellbores placed in a reservoir using an embodiment of the present invention.
Figure 10A:
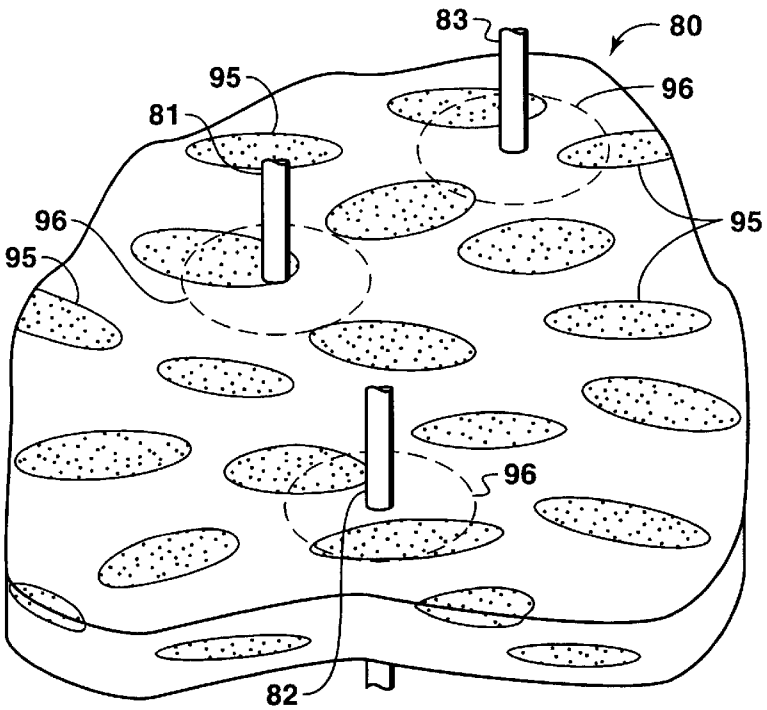

FIG. 10A shows a horizontal section (slice) of reservoir 80. This section contains three wells 81, 82, 83 that have been drilled into the reservoir and fractured by the multi-stage fracturing technique of the present invention. The section could be a single 100 ft slice representing one single-stage height of the well. The section also intercepts several lenses 95 of productive sand that are within this slice of the reservoir. Because only three wells are drilled into the reservoir, a number of the sand lenses are not intercepted by the fracture zone 96 of the wells.

To complete development of the reservoir, additional wells need to be drilled down to a spacing that is approximately equal to the effective drainage area of each well, i.e., 40,500 to 121,400 $m^2$ (10 to 30 acres). This effective drainage area also approximates the average area of the sand lenses in the vicinity of the wells. Drainage area of the wells refers to the cross-sectional area surrounding the wells within the reservoir which may not be the same as the surface area spacing. For example, it may be possible to more efficiently drill multiple directional wells from a single drilling site on the surface. It is anticipated that for many of the reservoirs in the Rocky Mountain basins the effective drainage area will be about 81,000 $m^2$ (20 acres) or less. Thus to fully exploit these lenticular sand reservoirs the bottomhole location of the wells should be spaced to approximate the drainage area of the well and the approximate average size of the sand lenses. FIG. 10B depicts the same reservoir cross-section 80 with 17 wells 101 to 117 properly spaced such that the collective drainage area of the wells covers nearly all of the reservoir.

With the field fully developed, substantially all of the lenticular sands are intercepted by the fracture zone 96 (depicted as circles) of at least one of the wells and the sands will therefore be productively drained. By developing the reservoir in this manner it is theoretically possible to intercept most of the lenticular sands 96 contained within the thickness of the reservoir. Because reservoir sands and properties and induced fracture mechanics can have a high level of variability, interception of all of the sand lenses may not be achieved in actual reservoir applications. Nevertheless the method of the present invention should result in a major portion of the reservoir lenticular sands being intercepted and drained provided the controlled multi-stage fracturing and proper well spacing described herein is performed.

The spacing of the wells within the reservoir should not be less than the approximate average cross-sectional area of the lenticular sands to which the lateral fractures have been roughly matched. Denser spacing beyond that described herein would be detrimental by creating unnecessary interference, overlapping drainage among wells, and increasing costs. Such excess drilling would not generate any additional gas overall and, in fact, may be counter productive to the controlled fracturing described herein. Therefore well spacing should not be less than the approximate average cross-sectional drainage area of the lenticular gas-bearing deposits. Alternatively, the approximate average drainage area of the lateral fractures along the length of the well should not be greater than the average cross-sectional area of the sand lenses in the vicinity of each well.

Much of the description of the method of the present invention relates to specific examples or illustrations. For example, controlling the lateral well fractures to drain an area of 40,500 to 121,400 $m^2$ (10 to 30 acres) is intended to intercept the lenticular sands in the vicinity of the well whose areal extent averages about the same size. Those skilled in the art of hydraulic fracturing and in the geology of lenticular hydrocarbon deposits will recognize that these illustrations are rough, idealistic approximations of the actual practice of the present invention. Geologists and reservoir engineers will recognize that the size, shape, distribution and physical properties of the lenticular deposits and surrounding formation will vary significantly even in well-defined basins. The Rocky Mountain region is one of geological variability and there is a high degree of discontinuity and unpredictability. Similarly, hydraulic fracturing is not as readily predictable or controllable because the induced fractures will encounter different types of formation rock besides the targeted sands.

There are also many natural fractures in these types of reservoir which further generate unpredictable results.

Those skilled in the art will therefore recognize that the "controlled" multi-stage fracturing method described herein is not precise and is an attempt to create a fracture which approximates the average size of the lenticular deposits near the wellbore. Therefore, limitations of precise measurement of fracture size, areal extent of the lenticular deposits, well-spacing and the like should not be read into the present invention. Instead the present invention is directed at approximating these interrelated variables using the information available to the practitioner. Using the information at hand and information which becomes available as wells are drilled during reservoir development, those skilled in the art will be able to use the present invention to economically exploit the heretofore non-commercial lenticular gas deposits of the Rocky Mountain region and other areas of the world where such deposits are found.

We claim:

1. A method for stimulating production from wells drilled into reservoirs characterized by lenticular gas-bearing deposits comprising:

(1) perforating said wells in a plurality of single-stage zones spaced along the thickness of said reservoir, (2) fracturing said single-stage zones in multiple stages, said stages being separated by ball sealers and said fracturing being controlled to create lateral fractures which will drain an area that approximates the average horizontal area of said lenticular gas-bearing deposits in the vicinity of said single-stage zones.

2. The method of claim 1 wherein said reservoir thickness is divided into a plurality of multi-stage zones, each multi-stage zone having two or more single stage zones.

3. The method of claim 1 wherein the height of said fractures are approximately equal to the corresponding vertical length of said single-stage zones.

4. The method of claim 1 wherein the total length of said lateral fractures approximates the average horizontal diameter of said lenticular gas-bearing deposits.

5. The method of claim 1 wherein the total length of said lateral fractures approximates the average length of said lenticular gas-bearing deposits, said length being the distance across said lenticular deposits in the direction of the orientation of said fractures.

6. The method of claim 1 wherein said fracturing is conducted using a non-Newtonian fluid.

7. The method of claim 6 wherein said non-Newtonian fluid is a cross-linked gelled water.

8. The method of claim 1 wherein said single-stage zones are perforated in the approximate geometric center of said zones.

9. A method for developing a reservoir characterized by lenticular gas-bearing deposits comprising:

(1) drilling a well into said reservoir, (2) perforating said well in single-stage zones spaced along the thickness of said reservoir, said reservoir thickness being divided into multiple multi-stage zones, each multi-stage zone having two or more single-stage zones, (3) fracturing said single-stage zones within each multi-stage zone in multiple stages, said stages being separated by ball sealers and said fracturing being controlled to create lateral fractures which will drain an area that approximates the average horizontal area of said lenticular gas-bearing deposits in the vicinity of said multi-stage zone, (4) repeating the process of drilling, perforating and fracturing additional wells into said reservoir such that the cross-sectional area in the reservoir surrounding each well is not less than the approximate average drainage area of the lateral fractures along the length of said well.

10. The method of claim 9 wherein the height of said fractures are approximately equal to the corresponding vertical length of said single-stage zones.

11. The method of claim 9 wherein the total length of said lateral fractures approximates the average length of said lenticular gas-bearing deposits, said length being the distance across said lenticular deposits in the direction of the orientation of said fractures.

12. The method of claim 9 wherein said fracturing is conducted using a non-Newtonian fluid.

13. The method of claim 12 wherein said non-Newtonian fluid is a cross-linked gelled water.

14. The method of claim 9 wherein said single-stage zones are perforated in the approximate geometric center of said zones.

15. The method of claim 9 wherein said cross-sectional area in the reservoir surrounding each well roughly equals the approximate average drainage area of the lateral fractures along the length of said well.

16. The method of claim 15 wherein said cross-sectional area in the reservoir surrounding each well averages between about 40,000 to 122,000 square meters (10 to 30 acres).

17. A method for developing a reservoir characterized by lenticular gas-bearing deposits comprising:

(1) drilling wells into said reservoir such that the average horizontal cross-sectional area in the reservoir surrounding each well is not less than the approximate average cross-sectional area of said lenticular gas-bearing deposits in said reservoir, (2) perforating said wells in single-stage zones spaced along the thickness of said reservoir, said reservoir thickness being divided into multiple multi-stage zones, each multi-stage zone having two or more single-stage zones, (3) fracturing said single-stage zones within each multi-stage zone in multiple stages, said stages being separated by ball sealers and said fracturing being controlled to create lateral fractures in each well which extend to the lenticular gas-bearing deposits in the vicinity of said well.

18. The method of claim 17 wherein the height of said fractures are approximately equal to the corresponding vertical length of said single-stage zones.

19. The method of claim 17 wherein the total length of said lateral fractures approximates the average length of said lenticular gas-bearing deposits, said length being the distance across said lenticular deposits in the direction of the orientation of said fractures.

20. The method of claim 17 wherein said fracturing is conducted using a non-Newtonian fluid.

21. The method of claim 20 wherein said non-Newtonian fluid is a cross-linked gelled water.

22. The method of claim 17 wherein said single-stage zones are perforated in the approximate geometric center of said zones.

23. The method of claim 22 wherein the approximate average drainage area of said fractures is not substantially greater than said average cross-sectional area of said lenticular gas-bearing deposits.

24. The method of claim 17 wherein said cross-sectional area in the reservoir surrounding each well roughly equals the approximate average cross-sectional area of said lenticular gas-bearing deposits.

25. The method of claim 24 wherein said cross-sectional area in the reservoir surrounding each well averages between about 40,000 to 122,000 square meters (10 to 30 acres).

* * * * *